United States Patent [19]

Saint-Pierre et al.

[11] 3,948,843

[45] Apr. 6, 1976

[54] ADDITIVES FOR OILS

[75] Inventors: Francoise Saint-Pierre, Paris; Bernard Chauvel, Ermont, both of France

[73] Assignee: Rhone-Progil, Courbevoie, France

[22] Filed: Mar. 28, 1974

[21] Appl. No.: 455,612

[30] Foreign Application Priority Data

Mar. 29, 1973 France ..... 73.11345

[52] U.S. Cl...... 260/30.4 A; 252/59; 260/33.6 AQ; 260/83.7; 260/85.1; 260/94.2 M; 260/880 B

[51] Int. Cl.[2]... C08K 5/01; C08K 5/15; C10M 1/18

[58] Field of Search ..... 260/880 B, 83.7, 94.2 M, 260/85.1, 33.6 AQ, 30.4 A

[56] References Cited

UNITED STATES PATENTS

| | | | |
|---|---|---|---|
| 2,996,459 | 8/1961 | Andersen et al. | 260/94.2 M |
| 3,113,986 | 12/1963 | Breslow et al. | 260/667 |
| 3,205,278 | 9/1965 | Lapporte | 260/667 |
| 3,595,942 | 7/1971 | Wald et al. | 260/880 B |
| 3,756,977 | 9/1973 | Yoshimoto et al. | 260/33.6 AQ |
| 3,827,999 | 8/1974 | Crossland | 260/33.6 AQ |

*Primary Examiner*—Donald E. Czaja
*Assistant Examiner*—H. H. Fletcher
*Attorney, Agent, or Firm*—McDougall, Hersh & Scott

[57] ABSTRACT

Additives for oils prepared by polymerizing by an anionic process at least one vinyl aromatic compound and at least one conjugated diene in the presence of a solvent, followed by hydrogenation of the formed copolymer in the presence of the solvent, in which the solvent is a support oil having a viscosity within the range of 1 to 24 cst at 50°C, a flash point of at least 120°C and a pour point which is no greater than −10°C.

10 Claims, No Drawings

ADDITIVES FOR OILS

This invention relates to additives for oils, particularly to additives enabling the viscosity index and the shearing resistance of lubricating oils to be improved; it also relates to new lubricating compositions containing such additives.

It is known that the viscosity index and shearing resistance of lubricating oils can be improved by means of additives prepared by hydrogenation of styrene or alkyl styrene conjugated diene copolymers obtained by anionic copolymerization. Proposals have been made for carrying out the hydrogenation and copolymerization operations in a single solvent selected from among the paraffinic hydrocarbons (such as propane, isobutane, pentane), the cycloparaffinic hydrocarbons (such as cyclopentane, cyclohexane, ethyl cyclohexane), the aromatic hydrocarbons (such as benzene, toluene), or mixtures of these. It has been found that the hydrogenated copolymers thus obtained must be separated from the solvent in which they have been prepared, before being added (generally with a "support oil") to the lubricating oils, in order that they shall not appreciably modify certain characteristics, notably the flash point, of said lubricating oils.

The applicants have now found that if the anionic copolymerization and hydrogenation operations are carried out in the presence of certain oils, to be defined below, it is not necessary to separate the hydrogenated copolymers from said oils, since these oils can serve as support oils for the copolymers in the lubricating oils.

According to one aspect of the invention, there is provided a method for the preparation of an additive for oils which comprises polymerizing, by an anionic process, at least one vinyl aromatic compound and of at least one conjugated diene in the presence of a solvent, followed by hydrogenation of the copolymer thus obtained in the presence of the solvent, the solvent being a "support" oil having a viscosity from 1 to 24 cst at 50°C, a flash point of at least 120°C and a pour point not greater than −10°C. The support oil preferably has a viscosity from 3 to 24 cst at 50°C.

The support oils which may be used in accordance with the method of this invention include: petroleum oils having a paraffinic tendency; fluid oils having a naphthenic tendency; hydrorefined oils; heavy alkyl benzenes containing at least 10 carbon atoms in their alkyl chain and saturated derivatives of these; branched paraffinic heavy solvents; polyisobutenes having a mean molecular weight of the order of 300 to 500.

The physical characteristics of said support oils mentioned in this specification are measured in accordance with:

— AFNOR T 60 118 standard for the flash point,

— ASTM D 97-65 standard for the pour point.

The vinyl aromatic compound is preferably selected from styrene and the alkyl styrenes; the conjugated diene is preferably selected from isoprene, butadiene or a mixture of these two.

The vinyl aromatic conjugated diene compound copolymers may be sequenced but are preferably statistical and may have a mean molecular weight of 25,000 to 125,000; the ratio by weight of vinyl aromatic compound/conjugated diene may be from 20/80 to 70/30; in the case of the preferred monomers referred to above, the content of polystyrene or polyalkyl styrene is a function of the content of 3,4 polyisoprene and/or of 1,2 polybutadiene.

The concentration of hydrogenated copolymer in the "support" oil is preferably from 5 to 30% by weight.

Suitable conditions for carrying out the copolymerization operation are as follows:

The operating temperature is from 20° to 80°C and preferably from 40° to 60°C.

The catalyst used is an organolithium compound; examples of such catalysts are given in French Pat. Nos. 1,161,238, 1,162,710, 1,218,060, 1,246,193 and 1,235,980; the preferred catalysts are primary and secondary butyl lithium.

The quantity of catalyst used is from $2 \times 10^{-4}$ to $4 \times 10^{-3}$ moles of lithium per 100 g of monomers to be copolymerized.

A polar solvent is added to the reaction medium, when it is desired to prepare statistical copolymers; this solvent may be of the ether, thioether or amine type; examples of polar solvents are given in French Pat. Nos. 1,218,060 and 1,235,980; the preferred solvent is tetrahydrofuran, and it is used in a proportion of from 0.1 to 5 parts per 100 parts of monomers.

The hydrogenation operation is preferably carried out in accordance with the method described in U.S. Pat. Nos. 3,113,986 and 3,205,278, in the presence of an organic transition metal salt - trialkyl aluminum catalytic system (such as nickel acetyl acetonate or octoate - triethyl or triisobutyl aluminum). This method enables more than 95% of the double olefin bonds and less than 5% of the double aromatic bonds of the copolymers to be hydrogenated. The hydrogenation operation may also be carried out in accordance with the method described in U.S. Pat. No. 2,864,809 in the presence of a reduced nickel catalyst — on kieselguhr.

After hydrogenation, the hydrogenation catalyst may be removed in known manner by treating the solution of hydrogenated copolymer with a mixture of methanol and hydrochloric acid. The colorless solution obtained may be decanted, washed with water and dried by passing through a drier column.

It has been found that hydrogenated copolymer solutions, prepared in accordance with the method of this invention, possess the advantage that they may be used without further treatment as additives to oils; notably to motor oils and mineral or synthetic hydraulic fluids, in order to improve their viscosity index and their shear resistance. The new lubricating compositions thus obtained may contain from 0.1% to 5% of their own weight of hydrogenated copolymer introduced in solution form; these compositions may also contain other conventional additives such as dispersing agents, anticorrosive agents, detergents, antioxidizing agents, and very high pressure additives.

The method according to the invention therefore makes it possible to simplify the operations involved and equipment used, and leads to a reduction in the time and expense required for the preparation of such lubricating compositions.

The invention will be illustrated by the following non-limiting examples.

EXAMPLE 1

This example relates to the preparation of an additive based upon a statistical styrene-isoprene hydrogenated copolymer in a hydrorefined oil.

a. Preparation of n-butyl lithium in dodecylbenzene:

A flask having a capacity of 1 liter and fitted with a reflux condenser, an addition flask and a stirring system is purged with purified nitrogen; then the flask is charged with:

— 200 ml of dodecylbenzene,

— and 3.8 g of metallic lithium (in the form of fine grains).

23 g of butyl chloride in 100 ml of dodecylbenzene are introduced drop by drop with energetic stirring.

The mixture is cooled to keep the temperature in the region of 80°C.

After the addition of the butyl chloride has been completed, stirring is continued for about 2 hours, and then the mixture is left to stand for overnight.

The solution is filtered under an inert atmosphere in order to remove the lithium chloride, and the solution of n-BuLi is collected in a dry vessel filled with purified nitrogen. Analysis shows that the solution contains approximately 0.40 mole of n-butyl lithium.

b. Copolymerization:

The following are introduced under a nitrogen atmosphere into a polymerization reactor purged with nitrogen:

— 1,500 ml of hydrorefined oil possessing the following characteristics:

| | |
|---|---|
| — sulphur content | <0.1% |
| — viscosity at 50°C | 16.6 cst |
| — viscosity at 98.9°C | 3.5 cst |
| — pour point | −15°C |
| — flash point | 210°C, |

and dried by passing it through an activated alumina column, calcium hydride and a molecular sieve.

— 74.2 ml of styrene purified by low pressure double distillation in the presence of calcium hydride, — 121.3 ml of isoprene purified by atmospheric pressure double distillation on calcium hydride, — 2 ml of tetrahydrofuran purified by passing over drier columns.

The reaction mixture is heated to 45°C; a small amount of dilute solution of n-butyl lithium is added drop by drop in order to remove the last traces of impurities, introduced by the reactants, and then the quantity of n-BuLi required for polymerization, i.e. $2.11 \times 10^{-3}$ mole, is introduced.

Copolymerization is carried on for 4 hours at 50°C.

A fraction of the solution is treated with isopropanol in order to precipitate the quantity of copolymer necessary for its characterization.

The molecular mass characteristics of said copolymer, determined by gel permeation chromatography, are as follows:

mean molecular mass in number $(\overline{M_n}) = 70{,}800$ mean molecular mass in weight $(\overline{M_w}) = 86{,}300$ polydispersivity factor $\left(\frac{\overline{M_w}}{\overline{M_n}}\right) = 1.22$ The ratio by weight of styrene/isoprene is 45/55.

c. Hydrogenation:

A hydrogenation reactor is purged with argon and the following are introduced under inert atmosphere:

— 3.26 g of nickel acetyl acetonate (0.0127 mole), or a ratio by weight of polymer/nickel of 200, — 5.79 g of triethyl aluminum (0.0508 mole), or a molar ratio of Al/Ni of 4, — 50 ml of oil.

The autoclave is closed. It is charged with hydrogen under a pressure of 7 kg/cm² and agitation is carried out for 15 minutes at normal temperature in order to preform the catalyst.

Degassification is then carried out; the reactor is opened and the polymerization solution is introduced under an inert atmosphere. The vessel is charged with hydrogen under a pressure of 20 kg/cm², stirring is commenced, and the mixture is heated to 100°C. The pressure is then adjusted to 30 kg/cm² hydrogen and the temperature is maintained for two hours. The mixture is then cooled and degassed; the hydrogenation solution is treated with a mixture of aqueous hydrochloric acid and methanol to kill the catalyst, washed with water and dried by passing through a drier column at 50°C. A fraction of the solution is precipitated with isopropanol for the purpose of characterizing the hydrogenated copolymer.

The amount of remaining olefinic unsaturation, determined by measuring the iodine number, is 4%.

Absorption spectography in the UV range establishes that the phenyl groups have not been hydrogenated. Gel permeation chromatography shows that modification of the molecular distribution has not taken place.

The hydrogenated copolymer solution obtained is practically colorless and has a concentration of 10%.

EXAMPLE 2

This example relates to the preparation of an additive based upon a statistical styrene-isoprene hydrogenated copolymer in oil having a paraffinic tendency.

The composition of the charge of polymerizer is as follows:

— 1,500 ml of oil having a paraffinic tendency of type 100 N, dried on activated alumina and calcium hydride, and possessing the following characteristics:

| | |
|---|---|
| — density | 0.88 |
| — viscosity at 37.8°C | 20.8 cst |
| — viscosity at 50°C | 16 cst |
| — viscosity at 98.9°C | 4.1 cst |
| — viscosity No. | 105 |
| — pour point | −15°C |
| — flash point | 214°C |

— 118 ml of styrene purified as in Example 1

— 65 ml of isoprene purified as in Example 1

— 0.4 ml of dry tetrahydrofuran

— $5 \times 10^{-3}$ mole of n-BuLi.

Characterization of the polymer on a fraction of solution precipitated with isopropanol:

$\overline{M_n} = 30{,}700$ $\overline{M_w} = 39{,}600$ $\overline{M_w}/M_n = 1.29$ Ratio by weight styrene/isoprene — 70/30

Hydrogenation is carried out under the conditions used in Example 1.

The degree of residual olefinic unsaturation is 5%.

The concentration of the hydrogenated copolymer in the oil is approximately 10%.

EXAMPLE 3

This example relates to the preparation of an additive on a base of a statistical styrene-isoprene hydrogenated copolymer in an oil having a naphthenic tendency.

The composition of the polymerizer charge is as follows:

— 1,500 ml of oil having a naphthenic tendency and possessing the following characteristics:

| | |
|---|---|
| — density | 0.84 |
| — viscosity at 20°C | 16.5 cst |
| — viscosity at 37.8°C | 8.5 cst |
| — viscosity at 50°C | 7.3 cst |
| — pour point | −39°C |
| — flash point | 140°C |
| — % sulphur | <0.01 |

— 105 ml of styrene
— 325 ml of isoprene
— 8 ml of tetrahydrofuran
— $6.4 \times 10^{-3}$ mole of n-BuLi Characteristics of the polymer:

$\overline{M}_n = 50{,}450$ $\overline{M}_w = 60{,}550$ $\overline{M}_w/\overline{M}_n = 1.20$ Ratio by weight of styrene-isoprene — 30/70.

Hydrogenation is carried out following the procedure of Example 1.

The degree of residual olefinic unsaturation is 3%.

The concentration of the hydrogenated copolymer in the oil is approximately 19%.

EXAMPLE 4

This example relates to the preparation of an additive on a base of a statistical styrene-isoprene hydrogenated copolymer in an alkyl benzene which is linear in $C_{14}$.

The composition of the polymerizer charge is as follows:

— 1,500 ml of alkyl benzene (linear in $C_{14}$) possessing the following characteristics:

| | |
|---|---|
| — viscosity at 20°C | 11 cst |
| — viscosity at 50°C | 4 cst |
| — viscosity at 100°C | 1.9 cst |
| — pour point | −60°C |
| — flash point | 176°C |

— 181 ml of styrene
— 243 ml of isoprene
— 4 ml of tetrahydrofuran
— $11 \times 10^{-3}$ mole of n-BuLi Characteristics of the copolymer:

$\overline{M}_n = 30{,}200$ $\overline{M}_w = 35{,}050$ $\overline{M}_w/\overline{M}_n = 1.16$ Ratio by weight styrene/isoprene = 50/50

Hydrogenation is carried out under the conditions of Example 1; the value of residual olefinic unsaturation is 4%.

The concentration of the hydrogenated copolymer in the alkyl benzene is approximately 20%.

EXAMPLE 5

This example relates to the preparation of an additive on a base of a sequenced styrene/isoprene hydrogenated copolymer in a hydrorefined oil.

The polymerization is carried out under the conditions of Example 1, but without tetrahydrofuran in order to enable a sequenced structure of the copolymer to be obtained.

Characteristics of the copolymer:

$\overline{M}_n = 71{,}100$ $\overline{M}_w = 83{,}900$ $\overline{M}_w/\overline{M}_n = 1.18$ Ratio by weight of styrene/isoprene = 45/55.

Hydrogenation is carried out following the procedure of Example 1.

The rate of residual unsaturation is 5%.

The concentration of the hydrogenated copolymer in the hydrorefined oil is approximately 10%.

EXAMPLE 6

This example relates to the preparation of an additive on a base of a statistical styrene-isoprene hydrogenated copolymer in a polyisobutene.

The composition of the batch of polymerizer is as follows:

1,500 of polyisobutene having the following characteristics:

| | |
|---|---|
| — viscosity at 50°C | 20 cst |
| — viscosity at 99°C | 4.8 cst |
| — molecular weight | 350 |
| — density | 0.84 |
| — pour point | −60°C |
| — flash point | 120°C |

— 40 ml of styrene
— 50 ml of isoprene
— 0.8 ml of tetrahydrofuran
— $2.8 \times 10^{-3}$ mole of n-butyl lithium.

Characteristics of the copolymer:

$\overline{M}_n = 25{,}900$ $\overline{M}_w = 32{,}350$ $\overline{M}_w/\overline{M}_n = 1.25$ Ratio by weight styrene/isoprene — 50/50.

Hydrogenation is carried out following the procedure of Example 1.

The rate of olefinic unsaturation after hydrogenation is 3%.

The concentration of the hydrogenated copolymer in the polyisobutene is approximately 5%.

EXAMPLE 7

This example relates to the preparation of an additive upon a base of a statistical styrene/isoprene/butadiene hydrogenated terpolymer in an oil having a paraffinic tendency.

The composition of the polymerizer charge is as follows:

— 600 ml of oil having a paraffinic tendency of type 100 N, the characteristics of which are given in Example 2
— 63.5 ml of styrene
— 20 ml of isoprene
— 50 ml of butadiene, purified in the vapor phase by passing through columns of calcium sulphate, potassium, calcium hydride and a molecular sieve — 0.6 ml of tetrahydrofuran
— $1.33 \times 10^{-3}$ mole of n-butyl lithium The terpolymer has the following characteristics:

$\overline{M_n} = 75{,}100$ $\overline{M_w} = 94{,}100$ $\overline{M_w}/\overline{M_n} = 1.2$ The ratio by weight of styrene/isoprene/butadiene = 57/13/30.

Hydrogenation is carried out following the procedure in Example 1.

The rate of residual olefinic unsaturation is 2%.

The final concentration in the oil is approximately 16%.

EXAMPLE 8

Comparative measurements of the viscosity number and of the shear resistance were carried out on lubricating oils of known commercially used composition containing, in one case, heavy alcohol copolymethacrylates, and in the other cases, the hydrogenated copolymers described above and all containing a multi-purpose additive. The multi-purpose additives at present, sold commercially, comprise amongst other things succinimides, polyalcohol esters, sulphurized alkyl phenolates, dithiophosphates, phosphates, antioxidizing agents of the phenol or amine type, and the like.

The results obtained are summarized in Table I; it may be noted that the viscosity numbers of the oils, on a base of hydrogenated copolymers, are identical to that of the reference oil on a base of copolymethacrylates for a very much smaller proportion of additive. In addition, the resistance to shear of these oils is very clearly improved.

The results obtained with the statistical copolymers are better than with the sequenced copolymer as a result of a greater compatibility with the lubricating oil.

TABLE 1

| | Propn. of additive % by weight of copolymer | Pour point ASTM D97-66 | Viscosity Number ASTM D2270-64 | Viscosity at 98.9°C in cst before shearing | Viscosity at 98.9°C in cst after shearing | Loss at shearing DIN 51-382 |
|---|---|---|---|---|---|---|
| COMMERCIAL COMPOSITION CONTAINING: | | | | | | |
| Copolymethacrylates | 6% | −33°C | 145 | 18.9 | 16.45 | 13 % |
| Example 1: S/I = 45/55 M = 70,000 statistical | 2.5 % | −35°C | 148 | 19.9 | 19.3 | 3 % |
| Example 2: S/I = 70/30 M = 30,000 statistical | 2.5 % | −40°C | 149 | 20.1 | 19.3 | 4 % |
| Example 3: S/I = 30/70 M = 50,000 statistical | 2.5 % | −40°C | 142 | 18.6 | 17.85 | 4 % |
| Example 4: S/I = 50/50 M = 30,000 statistical | 2.5 % | −45°C | 146 | 19.5 | 19.2 | 2 % |
| Example 5: S/I = 45/55 M = 70,000 sequenced | 2.5 % | −35°C | 135 | 20.4 | 18.7 | 6 % |
| Example 6: S/I = 50/50 M = 25,000 statistical | 1.5% | −50°C | 141 | 20.1 | 19.7 | 2 % |
| Example 7: S/I = 57/13/30 M = 75,000 statistical | 2.5 % | −35°C | 148 | 19.7 | 18.9 | 4 % |

EXAMPLE 9

The flash point was determined for lubricating oils containing 2.5% of statistical styrene-isoprene hydrogenated copolymer with an Mn of approximately 50,000, introduced in a 20% solution in different supports. This amounts to introducing 10% of solvent into the lubricating oil. The results are summarized in Table II.

The flash point of the lubricating oils used as starting material is 214°C.

TABLE II

| Support for the additive | Flash point of support | Flash point of oil after additive has been added | Flash point of oil with 1% solvent |
|---|---|---|---|
| Hexane | | below normal temperature | 96°C |
| Cyclohexane | − 1°C | below normal temperature | 96°C |
| 100 N | 214°C | 214°C | |
| Hydrorefined oil | 210°C | 210°C approx, | |
| Naphthenic oil | 140°C | 194°C | |
| Alkylbenzene (linear in $C_{14}$) | 176°C | 204°C | |
| Polyisobutene | 120°C | 184°C | |

We claim:

1. A method for the preparation of an additive for oils which comprises polymerizing by an anionic process, in the presence of a catalyst consisting of an organo lithium compound at least one vinyl aromatic compound and of at least one conjugated diene in the presence of a solvent, the copolymer obtained having a mean molecular weight within the range of 25,000 to 125,000 and a weight ratio of vinyl aromatic compound to conjugated diene compound from 20/80 to 70/30, hydrogenating olefinic bonds of said polymer in the presence of the same solvent, the solvent being a support oil having a viscosity from 1 to 24 cst at 50°C, a flash point of at least 120°C and a pour point not greater than −10°C, and being employed in an amount such that the concentration of hydrogenated copolymer in said oil is within the range of 5–30% by weight.

2. A method as claimed in claim 1, in which the support oil has a viscosity of from 3 to 24 cst at 50°C.

3. A method as claimed in claim 1, in which the support oil is selected from the group consisting of petroleum oils having a paraffinic tendency; fluid oils having a naphthenic tendency; hydrorefined oils; alkyl benzenes containing at least 10 carbon atoms in their alkyl chain, and saturated derivatives of these; branched paraffinic heavy solvents; and polyisobutenes of mean molecular weight from 300 to 500.

4. A method as claimed in claim 1, in which the vinyl aromatic compound is selected from the group consisting of styrene and the alkyl styrenes and the conjugated diene is isoprene, butadiene or a mixture thereof.

5. A method as claimed in claim 1, in which the copolymerization is performed at a temperature from 20° to 80°C.

6. A method as claimed in claim 5, in which the copolymerization is carried out at a temperature from 40° to 60°C.

7. A method as claimed in claim 1, in which the quantity of catalyst used is from $2 \times 10^{-4}$ to $4 \times 10^{-3}$ moles of lithium per 100 g of the monomers to be polymerized.

8. A method as claimed in claim 1, in which the copolymer is a statistical copolymer and the copolymerization is carried out in the presence of a polar solvent.

9. A method as claimed in claim 8, in which the polar solvent is tetrahydrofuran and is present in an amount from 0.1 to 5 parts by weight per 100 parts by weight of monomers.

10. A method as claimed in claim 1, in which hydrogenation is carried out in the presence of an organic transition metal salt-trialkyl aluminum catalyst or a reduced nickel/kieselguhr catalyst.

* * * * *